US006686677B2

(12) United States Patent
Kondo et al.

(10) Patent No.: US 6,686,677 B2
(45) Date of Patent: Feb. 3, 2004

(54) OPTICAL DEVICE

(75) Inventors: Yoshiteru Kondo, Takasago (JP); Kenji Tominaga, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 138 days.

(21) Appl. No.: 09/736,291

(22) Filed: Dec. 15, 2000

(65) Prior Publication Data

US 2003/0098637 A1 May 29, 2003

(30) Foreign Application Priority Data

Dec. 16, 1999 (JP) ..... 11-356760

(51) Int. Cl.[7] ..... H01J 5/02
(52) U.S. Cl. ..... 313/113; 313/637
(58) Field of Search ..... 313/113, 637, 313/638, 639; 362/341

(56) References Cited

U.S. PATENT DOCUMENTS 4,968,916 A * 11/1990 Davenport et al. ..... 313/113
5,109,181 A 4/1992 Fischer et al. ..... 313/571
5,427,858 A * 6/1995 Nakamura et al. ..... 400/271
5,497,049 A 3/1996 Fischer ..... 313/634
5,506,464 A * 4/1996 Ooms ..... 313/113
5,957,570 A * 9/1999 Ooyama et al. ..... 313/113
6,211,616 B1 * 4/2001 Takeuti et al. ..... 313/113

* cited by examiner

*Primary Examiner*—James Clinger
*Assistant Examiner*—Ephrem Alemu
(74) *Attorney, Agent, or Firm*—Nixon Peabody LLP; David S. Safran

(57) ABSTRACT

To provide an optical device in which fragments of a concave reflection mirror surrounding a discharge lamp and fragments of an optically permeable glass plate covering the aperture at the front of the concave reflection mirror do not fall and scatter, even if a short-arc high pressure discharge lamp that lights at extremely high mercury vapor pressure should rupture, the outer surface of the glass concave reflection mirror (20) surrounding the high pressure mercury discharge lamp (10) in which 0.16 mg/mm$^3$ or more of mercury is sealed in a discharge envelope is covered by a scatter prevention film (40) made of a polymer material, for example, a fluorine-based resin. Furthermore, a scatter prevention film is applied to the outer surface of the concave reflection mirror in a region of incidence of light over a range within ±40° of the direction orthogonal to the axis of the high pressure mercury discharge lamp. Scatter prevention film is applied to the periphery of optically permeable glass plate (30).

4 Claims, 2 Drawing Sheets

OPTICAL DEVICE

BACKGROUND OF THE INVENTION

1. Field of Invention

The present invention concerns a light-source device used in liquid crystal projection equipment, more specifically, a light-source device using a short-arc type of high pressure mercury discharge lamp having 0.16 mg/mm$^3$ or more of mercury sealed within a discharge envelope.

2. Description of Related Art

Light source devices having a short-arc type of high pressure lamp attached to a concave reflection mirror made of borosilicate glass are commonly used in liquid crystal projection equipment. Furthermore, various components in addition to the light-source device, especially a plurality of plastic components, are incorporated in liquid crystal projection equipment, but these components are incorporated at high density because of the need for miniaturization.

Incidentally, metal halide lamps having good color rendering in which are sealed mercury and metal halides have been used as conventional light source lamps because the uniform projection on a screen of images having adequate color rendering is required of liquid crystal projection equipment. The demand has risen recently for light sources having an extremely short separation between electrodes as miniaturization and spot light source development have proceeded further. However, in metal halide lamps in which metals having lower excitation energy than mercury are sealed, limits to discharge concentration develop when electrode separation falls below a given level and accommodation of smaller spot light source development becomes difficult.

For that reason, the short-arc type of high pressure mercury discharge lamp in which the mercury vapor pressure during lighting is high, for example, 20 MPa or above, has attracted attention. More than 0.16 mg/mm$^3$ of mercury is sealed in a discharge envelope to raise the mercury vapor pressure to such high levels during lighting, and such short-arc type of high pressure mercury discharge lamps inhibit arc expansion, enhance photo output and improve the color rendering.

The gazettes of Japanese Kokai Publication Hei-2-148561 (U.S. Pat. No. 5,109,181) and Japanese Kokai Publication Hei-6-52830 (U.S. Pat. No. 5,497,049) present such short-arc type of high pressure mercury discharge lamps.

However, discharge lamps that light at such extremely high mercury vapor pressure may suffer damage to their discharge envelope during lighting, and could rupture in extreme cases. If a lamp should rupture, the concave reflection mirror made of glass could also be destroyed by the impact, with the result being that fragments of the concave reflection mirror could fall and scatter. Furthermore, the front aperture of the concave reflection mirror have been covered by an optically permeable glass plate to prevent the scattering of fragments from a broken lamp, but there are cases in which this optically permeable glass plate is also destroyed by the impact of lamp rupture. Of course, other components incorporated densely in the device would be adversely affected if the concave reflection mirror and the optically permeable glass plate covering the aperture at the front of the concave reflection mirror should rupture and fragments should scatter.

SUMMARY OF THE INVENTION

Thus, the purpose of the present invention is to provide an optical device in which the concave reflection mirror surrounding a discharge lamp and fragments of optically permeable glass plate covering the aperture at the front of the concave reflection mirror do not fall and scatter even if a short-arc type of high pressure mercury discharge lamp should be ruptured during lighting at extremely high mercury vapor pressure.

To attain such objectives, the invention provides an optical device comprising a quartz glass discharge envelope in which 0.16 mg/mm$^3$ or more of mercury is sealed, a short-arc type of high pressure mercury discharge lamp having sealing sections formed at both ends of said discharge envelope, and a glass concave reflection mirror surrounding the high pressure mercury discharge lamp in which a sealing section of the high pressure mercury discharge lamp is attached, and wherein a scatter prevention film of a polymer material is applied to the outer surface of the concave reflection mirror. By using such a scatter prevention film of polymer material, the extent of damage occurring due to breakage of the concave reflection mirror can be inhibited and the falling of fragments of the concave reflection mirror can be prevented even if the discharge lamp should rupture.

Scatter prevention film made of polymer material is expensive and reducing the area of the scatter prevention film would be desirable. The results of serious examination revealed that the site where cracking of a concave reflection mirror commences lies in a restricted region when a discharge lamp ruptures. Thus, the present invention also concerns an optical device in which said scatter prevention film is applied to the outer surface of the concave reflection mirror in a region of incidence of light over a range within ±40° of a direction orthogonal to the axis of said high pressure mercury discharge lamp from all of the light radiated from the arc luminance point of the high pressure mercury discharge lamp.

Furthermore, the polymer material of which the scatter prevention film is formed is preferably a fluorine-based resin.

Next, when the aperture at the front of the concave reflection mirror is covered by an optically permeable glass plate to prevent scattering of fragments of a ruptured lamp from the aperture at the front of the concave reflection mirror according to the present invention or when a scatter prevention film is applied to the periphery of an optically permeable glass plate according to the present invention, the falling of fragments of the optically permeable glass plate can be prevented without significantly attenuating the luminous flux.

A mode of implementing the present invention is explained in detail below with reference to the accompanying drawings.

DETAILED DESCRIPTION OF THE INVENTION

Figure 1:
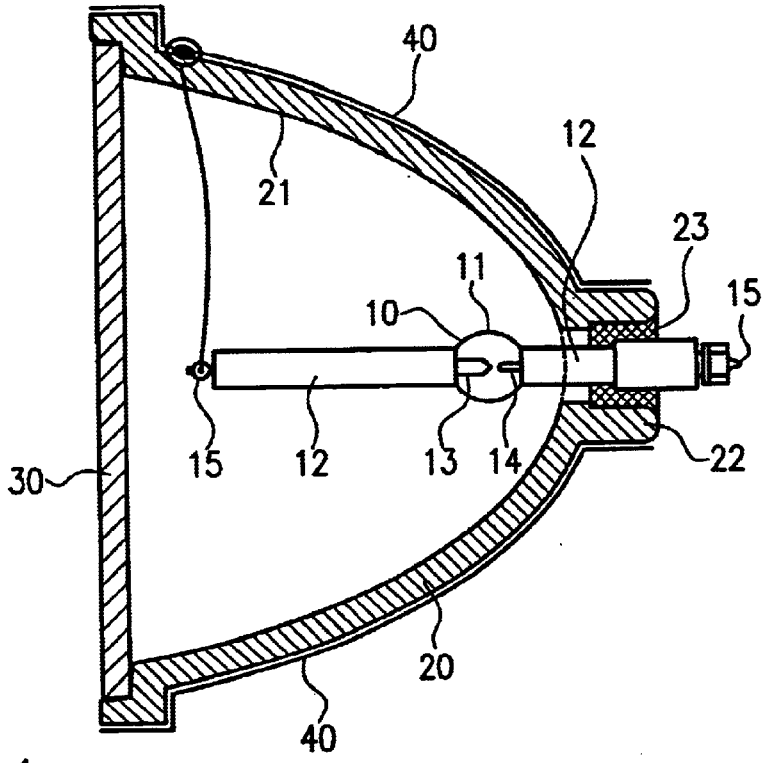
FIG. 1 is a cross-sectional view of an embodiment of the present invention.

A discharge envelope 11 of the short-arc type of high pressure mercury discharge lamp 10, in FIG. 1 is a roughly spherical unit composed of quartz glass. A pair of electrodes, an anode 13 and a cathode 14 are disposed facing each other within discharge envelope 11. In addition, mercury and a rare gas are sealed within discharge envelope 11. Sealing sections 12 are connected integrally at opposite sides of discharge envelope 11. Sealing sections 12 are formed by depressurization of the interior while the quartz glass bulbs extending from both ends of discharge envelope 11 are in the molten state. In short, they are formed by the shrink sealing method. Molybdenum foil (not illustrated) electrically connects the anode 13, cathode 14 and external lead 15 and is embedded within sealing sections 12.

The polarity of the direct current lighting type of anode 13 and cathode 14 may be opposite from that shown in FIG. 1, and alternating current lighting type may also be used. Furthermore, sealing sections 12 may also be formed by the pinch seal method in which the quartz glass bulb is compressed while in the molten state.

Specific examples of short-arc type of the high pressure mercury discharge lamp 10 will now be described. In the illustrated example, the amount of mercury sealed within the envelope 11 is 0.20 mg/mm$^3$ while 10 KPa pressure of argon gas is sealed as the rare gas. Furthermore, the electrode separation is 1.5 mm, the internal volume of the discharge envelope 11 is 260 mm$^3$, the rated voltage is 82 V and the rated consumed power is 200 W. Of course, these values are not sole ones usable. However, an amount of mercury in excess of 0.16 mg/mm$^3$ must be sealed in the envelope 11 when short-arc type of high pressure mercury discharge lamp 10 is used as the light source lamp for a liquid crystal projector.

A concave reflection mirror 20 may be constructed of borosilicate glass, for example, and the minor diameter of the aperture at the front would be about 120 mm. Reflection surface 21 of the concave reflection mirror 20 is a rotating curved surface, with a vapor deposited surface of titania silica, for example, having outstanding reflection characteristics, formed on the surface. A support tube 22 is formed at the top of the concave reflection mirror 20 and a sealing section 12 of the discharge lamp 10 is inserted in the support tube 22. The axis of discharge lamp 10 is aligned with the optical axis of the concave reflection mirror 20, and the lamp is attached to the concave reflection mirror 20 via adhesive 23 packed in the support tube 22 while the arc bright point formed between the electrodes 13, 14 during lighting is situated at the first focal point of concave reflection mirror 20.

The aperture at the front of the concave reflection mirror 20 is covered by an optically permeable glass plate 30 made of borosilicate glass, for example, so that fragments would not scatter from the aperture at the front if the high pressure mercury discharge lamp 10 should break. However, such an optically permeable glass plate 30 is not always required.

A scatter prevention film 40 composed of a polymer material is applied to the outer surface of concave reflection mirror 20. The film thickness of scatter prevention film 40 is 0.05 mm, for example, but scatter prevention film 40 is extremely tough since it is polymer material. Accordingly, even if concave reflection mirror 20 is broken upon impact when high pressure mercury discharge lamp 10 is ruptured, the film 40 would be strong enough that, even if the mirror cracks, fragments would be checked by the scatter prevention film 40 and scattering would be prevented.

Fluorine-resin, silicon resin, polyimide resin, etc., can be used as constituent polymer material of scatter prevention film 40, and glass fiber impregnated with these polymer materials may also be used. Fluorine-based resins, such as polytetrafluoroethylene (registered trade name: PFA resin), would be most desirable among these polymer materials since they have scant volatile components and few volatile impurities would develop from the scatter prevention film 40 even if the outer surface of concave reflection mirror 20 should reach a temperature exceeding 200° C. during lighting. Furthermore, such resins suffer little serial deterioration because of their good heat resistance and light resistance. In addition, they have great flexibility and strength when scatter prevention film 40 reaches high temperatures during lighting, and they are especially effective in scatter prevention of fragments.

Scatter prevention film 40 was applied to the entire outer surface of concave reflection mirror 20 in the embodiment shown in FIG. 1, but its application only to the outer surface of those regions of concave reflection mirror 20 which are highly susceptible to damage would be desirable since a scatter prevention film 40 comprising a polymer material is expensive. Accordingly, the results of thorough examinations by the inventors revealed that the application of scatter prevention film 40 to the outer surface of concave reflection mirror 20 in a region of incidence of light over a range within ±40° of the direction orthogonal to the axis of high pressure mercury discharge lamp 10 from all of the light radiated from the arc luminance point formed between electrodes 13 and 14 in high pressure mercury discharge lamp 10 having 0.16 mg/mm$^3$ or more of mercury sealed within luminous envelope 11 would be best.

Figure 2A:
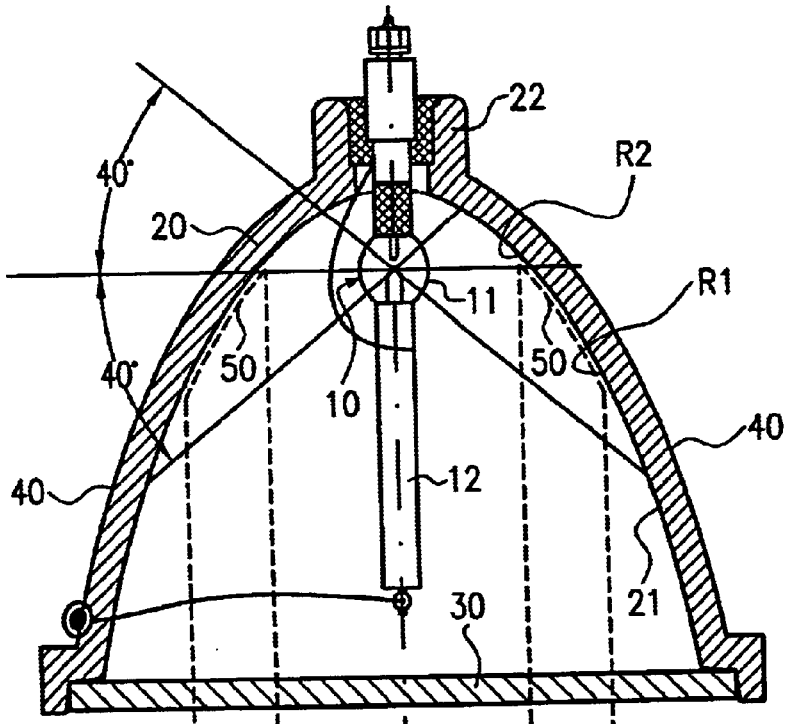
FIGS. 2(A) and 2(B) are explanatory diagrams showing the site of damage to the concave reflection mirror in cross-sectional and front elevational views, respectively.
Figure 2B:
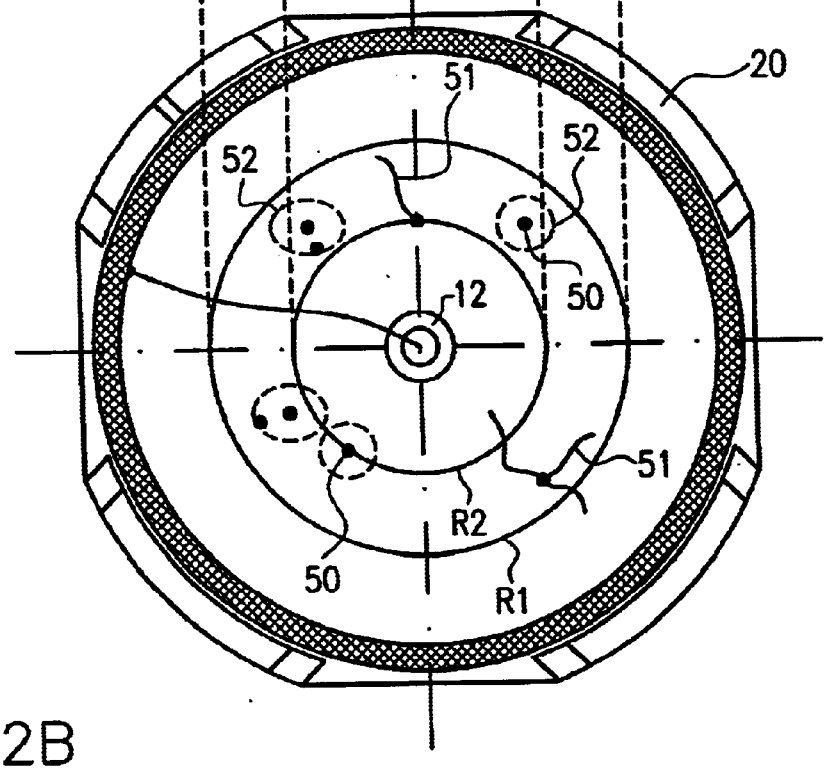

FIGS. 2(A) & 2(B) are diagrams which show the state of damage to concave reflection mirror 20 when it is intentionally ruptured by the provision of excess power to the high pressure mercury discharge lamp 10. FIG. 2(A) is a transverse cross-sectional view of concave reflection mirror 20 while FIG. 2(B) is a view from the side of the aperture at the front of concave reflection mirror 20 with the optically permeable glass plate 30 removed. The black dots denoted by reference number 50 in FIG. 2 represent the point of crack initiation of concave reflection mirror 20 when high pressure mercury discharge lamp 10 ruptured. As this indicates, crack initiation point 50 lies between circle R1 and circle R2 intersected by the plane orthogonal to the optical axis concave reflection mirror 20, and cracks do not occur in ranges outside of circle R1 and circle R2.

Crack 51 extends radially from crack initiation point 50, fragment 52 represented by the dotted line forms with crack 51 becoming a closed loop, and crack 51 as well as fragment 52 can extend outside of circle R1 and circle R2. However, the possibility of crack 51 and fragment 52 developing outside of the region of incident light over a range within ±40° of the direction orthogonal to the axis of high pressure mercury discharge lamp 10 from all of the light radiated from the arc luminance point is extremely low. Accordingly, the application of scatter prevention film 40 only to the outer surface of concave reflection mirror 20 in this range would adequately prevent the scattering of fragment 52 and would be cost-effective.

If the aperture at the front of concave reflection mirror 20 is covered by optically permeable glass plate 30 to prevent the scattering of fragments from the entire aperture surface when high pressure mercury discharge lamp 10 ruptured, optically permeable glass plate 30 would also be ruptured by the impact due to rupture of high pressure mercury discharge lamp 10. As a result, the fragments of optically permeable glass plate 30 would fall and scatter. Thus, the application of scatter prevention film 40 of polymer material to optically permeable glass plate 30 would also be effective. However, the application of scatter prevention film 40 to the entire surface of optically permeable glass plate 30 obstructs the permeability of light discharged from high pressure mercury discharge lamp 10 and the luminous flux is attenuated.

Figure 3:
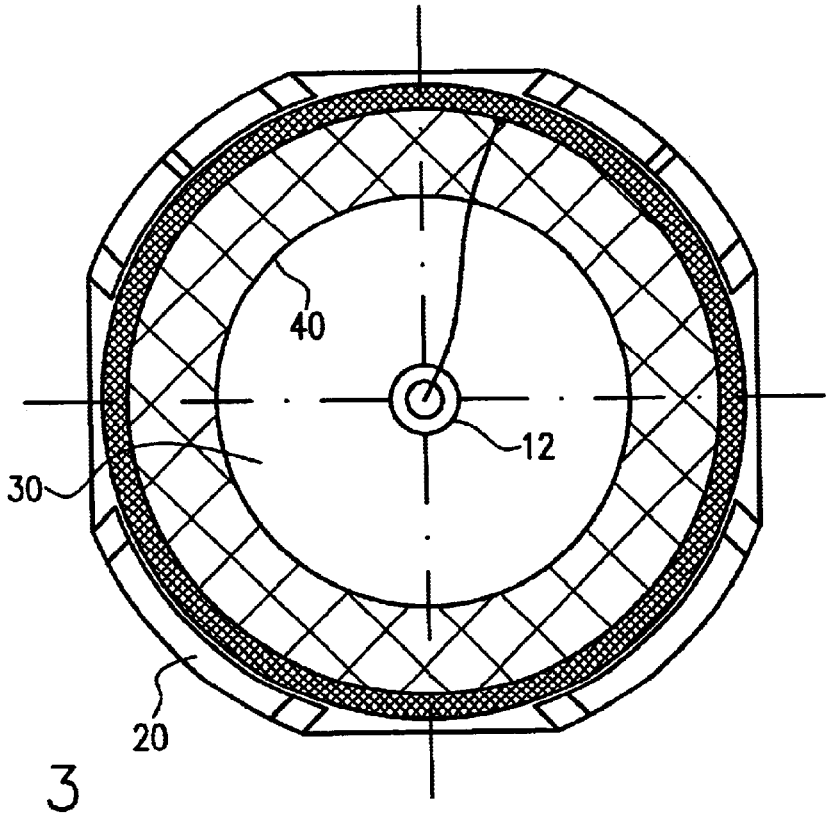
FIG. 3 is a front view of an embodiment of the present invention.

Thus, scatter prevention film 40 should be applied to the periphery of optically permeable glass plate 30 as indicated by the reticulated section in FIG. 3. Accordingly, even if the position of crack initiation of optically permeable glass plate 30 occurring due to rupture of high pressure mercury discharge lamp 10 should be the center of optically permeable glass plate 30, the crack would propagate toward the periphery of optically permeable glass plate 30 and fragments from the periphery would fall, but the propagation of cracks would be arrested at the periphery of scatter prevention film 40 by applying scatter prevention film 40 to the periphery of high pressure mercury discharge lamp 10 and fragments of optically permeable glass plate 30 would not fall and scatter. Therefore, the permeation of light through optically permeable glass plate 30 would not be obstructed by scatter prevention film 40 and attenuation of the luminous flux could be arrested since scatter prevention film 40 is not applied to the center of optically permeable glass plate 30.

Effects of Invention

As explained above, the optical device pursuant to the present invention has a scatter prevention film of polymer material, for example, a fluorine-based resin, applied to the outer surface of a glass concave reflection mirror surrounding a high pressure mercury discharge lamp in which 0.16 $mg/mm^3$ or more of mercury are sealed in a discharge envelope of quartz glass. Accordingly, even if the discharge lamp should rupture, any cracks would develop just in the concave reflection mirror but the falling and scattering of fragments of the concave reflection mirror could be prevented. Therefore, the application of scatter prevention film to the outer surface of concave reflection mirror in a region of incidence of light over a range within ±40° of the direction orthogonal to the axis of a high pressure mercury discharge lamp from all of the light radiated from the arc luminance point of a high pressure mercury discharge lamp would adequately prevent the scattering of fragment 52 and would be cost-effective.

The luminous flux would not be significantly attenuated and the falling of fragments of the optically permeable glass plate would be prevented by applying scatter prevention film to the periphery of the optically permeable glass plate when the aperture at the front of the concave reflection mirror is covered by an optically permeable glass plate to prevent the scattering of fragments of a rupture lamp from the aperture at the front of the concave reflection mirror.

What is claimed is:

1. An optical device comprising a quartz glass discharge envelope in which at least 0.16 mg/mm3 of mercury is sealed, a short-arc type of high pressure mercury discharge lamp having sealing sections formed at both ends of said discharge envelope, and a glass concave reflection mirror surrounding said high pressure mercury discharge lamp in which a sealing section of the high pressure mercury discharge lamp is attached, wherein a scatter prevention film comprised of a polymer material is applied to an outer surface of the glass concave reflection mirror, and wherein said scatter prevention film is applied on the outer surface of the concave reflection mirror in a region of incidence of light over a range within ±40° of a direction orthogonal to an axis of said high pressure mercury discharge lamp from all of the light radiated from an arc luminance point of the high pressure mercury discharge lamp.

2. The optical device of claim 1, wherein said polymer material is a fluorine-based resin.

3. The optical device of claim 2, wherein a frontal aperture of the concave reflection mirror is covered by an optically permeable glass plate.

4. The optical device of claim 3, wherein said scatter prevention film is applied to only a peripheral area of the optically permeable glass plate.

* * * * *